US006098432A

United States Patent [19]

Spies

[11] Patent Number: 6,098,432

[45] Date of Patent: Aug. 8, 2000

[54] CLOSURE FOR DOORS, BONNETS, TAILGATES OR THE LIKE, IN PARTICULAR OF VEHICLES, SUCH AS MOTOR VEHICLES

[75] Inventor: Wolfgang Uwe Spies, Haan, Germany

[73] Assignee: Huf Hulsbeck & Fürst GmbH & Co. KG, Velbert, Germany

[21] Appl. No.: 09/214,088

[22] PCT Filed: Jun. 26, 1997

[86] PCT No.: PCT/EP97/03348

§ 371 Date: Dec. 28, 1998

§ 102(e) Date: Dec. 28, 1998

[87] PCT Pub. No.: WO98/01643

PCT Pub. Date: Jan. 15, 1998

[30] Foreign Application Priority Data

Jul. 4, 1996 [DE] Germany ..... 196 26 914
Jun. 10, 1997 [DE] Germany ..... 197 24 318

[51] Int. Cl.[7] ..... E05B 65/36

[52] U.S. Cl. ..... 70/237; 70/255; 70/264; 70/DIG. 30

[58] Field of Search ..... 70/237, 254, 255, 70/257, 264, 277, 279.1, 278.3, DIG. 30; 292/201

[56] References Cited

U.S. PATENT DOCUMENTS

| | | | |
|---|---|---|---|
| 3,200,623 | 8/1965 | Peters | 70/255 |
| 4,649,272 | 3/1987 | Lipschutz | 70/255 X |
| 5,050,410 | 9/1991 | Claar et al. | 70/237 |
| 5,175,440 | 12/1992 | Robitschko et al. | 70/264 X |
| 5,184,022 | 2/1993 | Claar et al. | 70/237 X |
| 5,224,364 | 7/1993 | Claar et al. | 70/237 |
| 5,295,374 | 3/1994 | Bender et al. | 70/208 |
| 5,539,165 | 7/1996 | Wu | 70/DIG. 30 X |
| 5,566,562 | 10/1996 | Fujii | 70/277 |
| 5,638,712 | 6/1997 | Kuroda | 70/264 X |
| 5,715,713 | 2/1998 | Aubry et al. | 70/277 |

FOREIGN PATENT DOCUMENTS

| | | | |
|---|---|---|---|
| 1072142 | 12/1959 | Germany | 70/264 |

*Primary Examiner*—Lloyd A. Gall
*Attorney, Agent, or Firm*—Friedrich Kueffner

[57] ABSTRACT

The invention concerns a closure with a closure cylinder whose cylinder core (33) can be moved by a key into different operating positions. The object of the invention is for at least one microswitch (50) to be actuated by switching cams (42) only once, even if the switching cam (42) continues to be moved when the microswitch (50) has been actuated. During the return movement, this microswitch (50) should not be triggered by the switching cam (42) again, and so faulty switching is avoided. To that end, a control member (40) cooperates via a separable coupling (35, 45) with a control member (40) on which the switching cam (42) is located. The control member (40) is acted upon by a restoring spring (46) which endeavors to move the control member into an initial position and simultaneously subject it to a force (43) in the coupling sense by the cylinder core (33). By controlling the lift as it moves, the control member (40) is moved axially out of a coupling plane (69) into an uncoupling plane (67) in which it can return to its normal position (40) again under the effect of the restoring spring (46). This restoring movement in the uncoupling plane (67) occurs at a distance from the microswitch (50), such that the switching cam (42) does not actuate the microswitch (50) again.

21 Claims, 15 Drawing Sheets

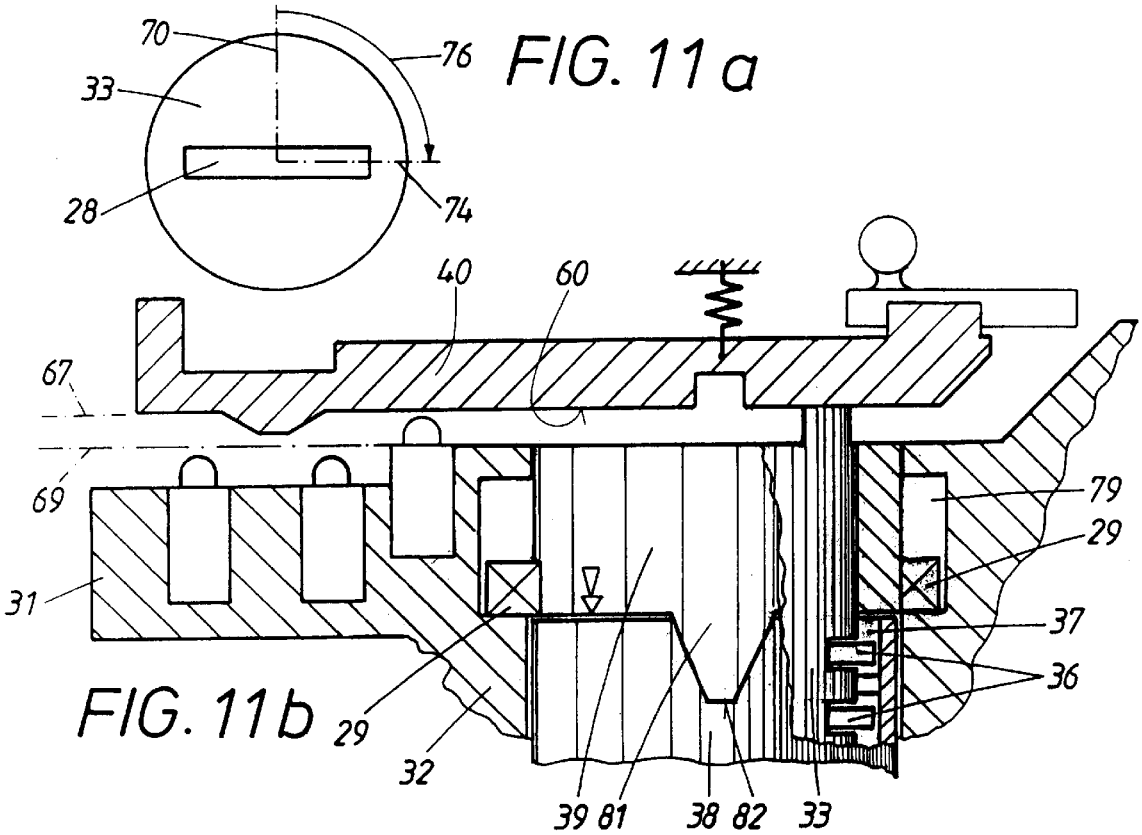
FIG. 11a
FIG. 11b
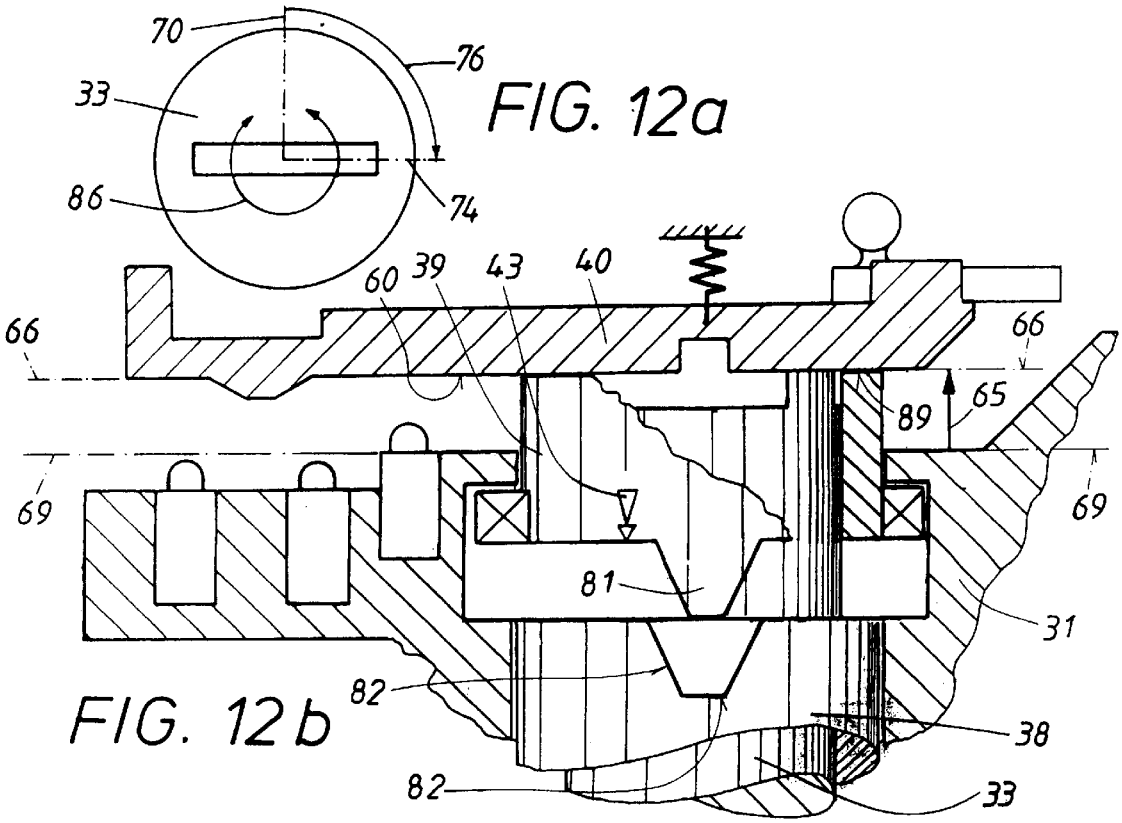
FIG. 12a
FIG. 12b

FIG. 13a
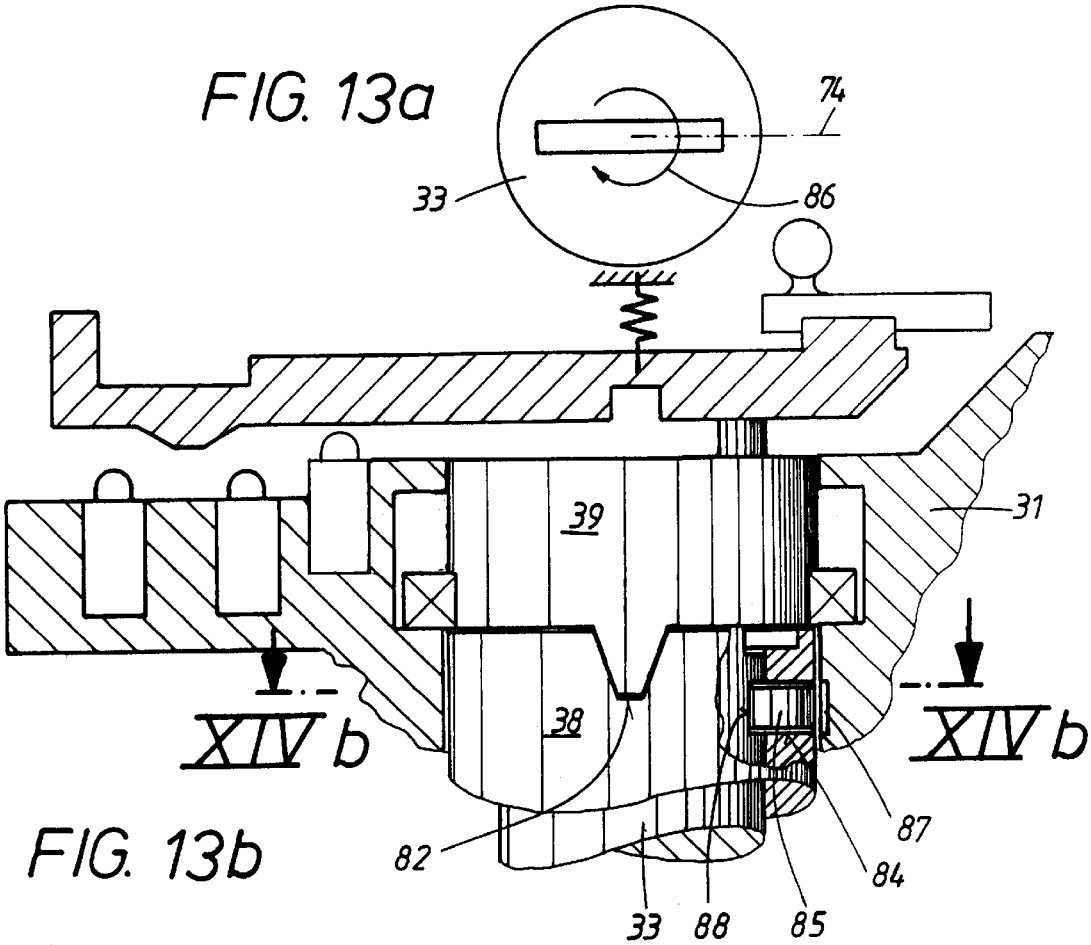
FIG. 13b
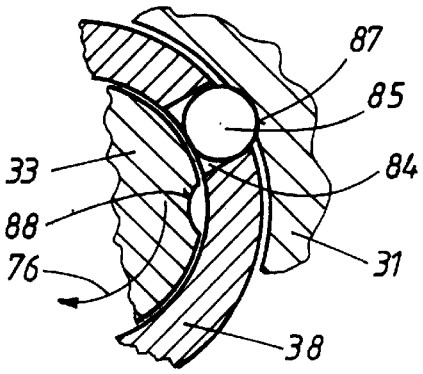
FIG. 14a
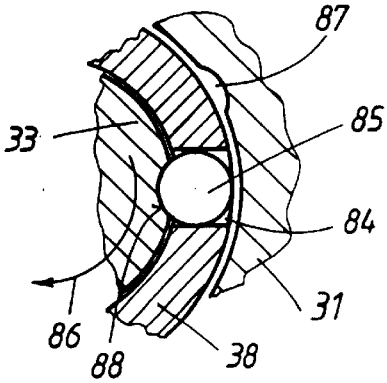
FIG. 14b

CLOSURE FOR DOORS, BONNETS, TAILGATES OR THE LIKE, IN PARTICULAR OF VEHICLES, SUCH AS MOTOR VEHICLES

BACKGROUND OF THE INVENTION

The invention pertains to a lock which is used in particular as a rear lock in the trunk lid of a motor vehicle. In this lock, the cylinder core of the lock cylinder can be rotated by a properly fitting key out of a neutral position, which is determined by a pulse spring, into any one of three different working positions. After rotation in a pulse-wise manner into a first working position, called the "unsecured" position, the lock can be opened by the operation of a handle. In this position, an active connection between the lock and the handle is established. This does not apply to the second and third working positions, called the "secured" and the "safe-secured" or simply "safe" positions, respectively. In these cases, the handle is inoperative, for which reason the lock does not move when the handle is actuated. In the neutral position, a key can be inserted into the cylinder core and removed again; its pulse spring automatically returns the cylinder core to this neutral position from the unsecured or secured position. A key can also be inserted and removed in the safe position, in which the cylinder core remains after it has been rotated by the key.

The rotation of the cylinder core of the lock into the various working positions is reported to a central locking device, referred to in abbreviated form below as the "CL" device. The CL device acts on other locks on the motor vehicle, which are controlled in a corresponding manner. The locking mechanisms provided for these additional locks are rendered operative or inoperative by the CL device in the same way. But when the lock is in its safe position, the CL device cannot bring it back again into the unsecured position (in which the handle can be used to open the associated lock) when a key is used to actuate the cylinder core of any of the other locks.

When a key is used to rotate the cylinder core, a switch actuator is moved as well; as this actuator moves from the neutral position to the secured position or from the neutral position to the unsecured position, it actuates a microswitch. In each case, this microswitch initiates specific additional functions in the motor vehicle; for example, it can initiate the previously mentioned control function of the CL device or turn an electrical anti-theft warning system on or off. When the cylinder core is rotated beyond the secured position and into the safe position, the switch actuator moves to the other side of the microswitch, where, in the case of the known lock, it is held. Therefore, as already mentioned, the locking mechanism belonging to this lock remains blocked in the safe position, because the handle is inoperative. When, in the known lock, a key is used to rotate the cylinder core out of the safe position and back into the neutral position, so that the key can be removed again in the neutral position, the cylinder core passes through the secured position again on its return route, and the switch actuator actuates the microswitch again. As a result, the functions associated with the secured position are initiated yet again, such as, for example, the turning-on of the anti-theft warning system, the blocking of the locking mechanism, and the blocking of the CL device. In the case of the known lock, this can lead not only to inconvenient situations but also to dangerous ones.

A dangerous situation can result in the case of a vehicle with an array of locks on the doors and on the tailgate, which can be controlled from a central location by the CL device.

Whereas the locks on the doors have three working positions (neutral position, secured position, an unsecured position), the lock for the tailgate can also be moved into the previously mentioned safe position; in the case being assumed here, this is the position in which it is supposed to remain. When a key is then used in one of the locks to change the locks on the doors into the unsecured position by way of the CL device, the lock on the tailgate remains in the safe position. When, finally, a key is used to turn the lock on the tailgate back into the neutral position (not to the unsecured position) and the key is pulled out, the switch actuator located at the tailgate passes over the microswitch, when initiates the cited functions for the secured position again. This means that the CL device is induced to return the locks of all the doors to the "secured" position. Now all the doors of the vehicle are closed, and any passengers who may be in the vehicle are trapped.

Another conceivable case, which is relatively harmless but still inconvenient, is present when the tailgate lock is moved back from the safe position to the neutral position while one of the doors is open. In this case, the anti-theft warning system is turned on and an alarm is triggered when the switch actuator moves across the microswitch. This leads to unnecessary noise.

The invention is based on the task of developing a reliable, compact lock which requires the fewest possible number of components and yet allows the cylinder core to be rotated between the neutral position and the three working positions cited above without the occurrence of any control problems involving the switch actuator carried along by the cylinder core.

Because, when the cylinder core is in the safe position, the control element is in a disconnection plane and thus automatically disengaged from the cylinder core, there is no need for any additional locking elements which would be required to disconnect the pulse spring from the cylinder core in the safe position. The pulse spring can always remain connected to the control element. It is also impossible for any contradictory control commands to be sent to the CL device; the reason for this is that, because the control element is situated in the disconnection plane, the switch actuator provided on the control element is a certain distance away from the microswitch and, when the actuator executes its return movement starting from the safe position, it passes by the microswitch without affecting it in any way. Although the control element with its switch actuator is automatically returned by the pulse spring to the normal position, which corresponds to the neutral position of the cylinder core, it nevertheless leaves the microswitch unactuated. When the cylinder core is returned by a properly fitting key from the safe position via the secured position to the neutral position, it no longer needs to return the control element, carrying the switch actuator, since the control element is already in its normal position, aligned with the core. In the neutral position of the cylinder core, a connection is established automatically again between the core and the control element, because the force of the spring acting on the control element moves it back into its connection plane. As the rotation continues and the cylinder core arrives in the unsecured position, the control element is able to move in the connection plane again and can use its switch actuator to actuate another microswitch, which then logically reverses the settings of the vehicle's electrical device thus, for example, deactivating the anti-theft warning system again and/or controlling the CL device.

An especially simple design of the lock according to the invention is obtained when the axial movement of the control element between the various planes is used to actuate one or more microswitches, which then can take over other functions in the motor vehicle. Thus, it is recommended that a third microswitch be inserted into the circuit of the two previously mentioned microswitches and that this third switch be actuated directly by the control element. The third microswitch can interrupt the entire electrical circuit when the control element moves out the connection plane into the disconnection plane or some other plane. This results in a very high level of security against forced entry in a vehicle equipped with this lock. It also means that a key in the cylinder core can turn the lock to the "safe" position or to a "garage" position.

Additional measures and advantages of the invention can be derived from the subclaims, from the following description, and from the drawings. The drawings present two different exemplary embodiments of the invention and also a simplified schematic diagram to help explain the special way in which the invention works:

BRIEF DESCRIPTION OF THE DRAWINGS

FIGS. 8*a*, 8*b*, 9*a*, 9*b*, 10*a*, 10*b*, 11*a*, 11*b*, 12*a*, 12*b*, 13*a*, 13*b* show the various working positions of the lock according to the invention in schematic, flat, developed views of various components which are circular in and of themselves; a second, alternative design is shown in FIGS. 8*c*, 9*c*, and 10*c*;

FIGS. 14*a* and 14*b* show radial cross sections, along line XIVb—XIVb, of details of the device shown in FIG. 13*b*, in two different working positions;

DETAILED DESCRIPTION OF THE PREFERRED EMBODIMENT

Figure 5:
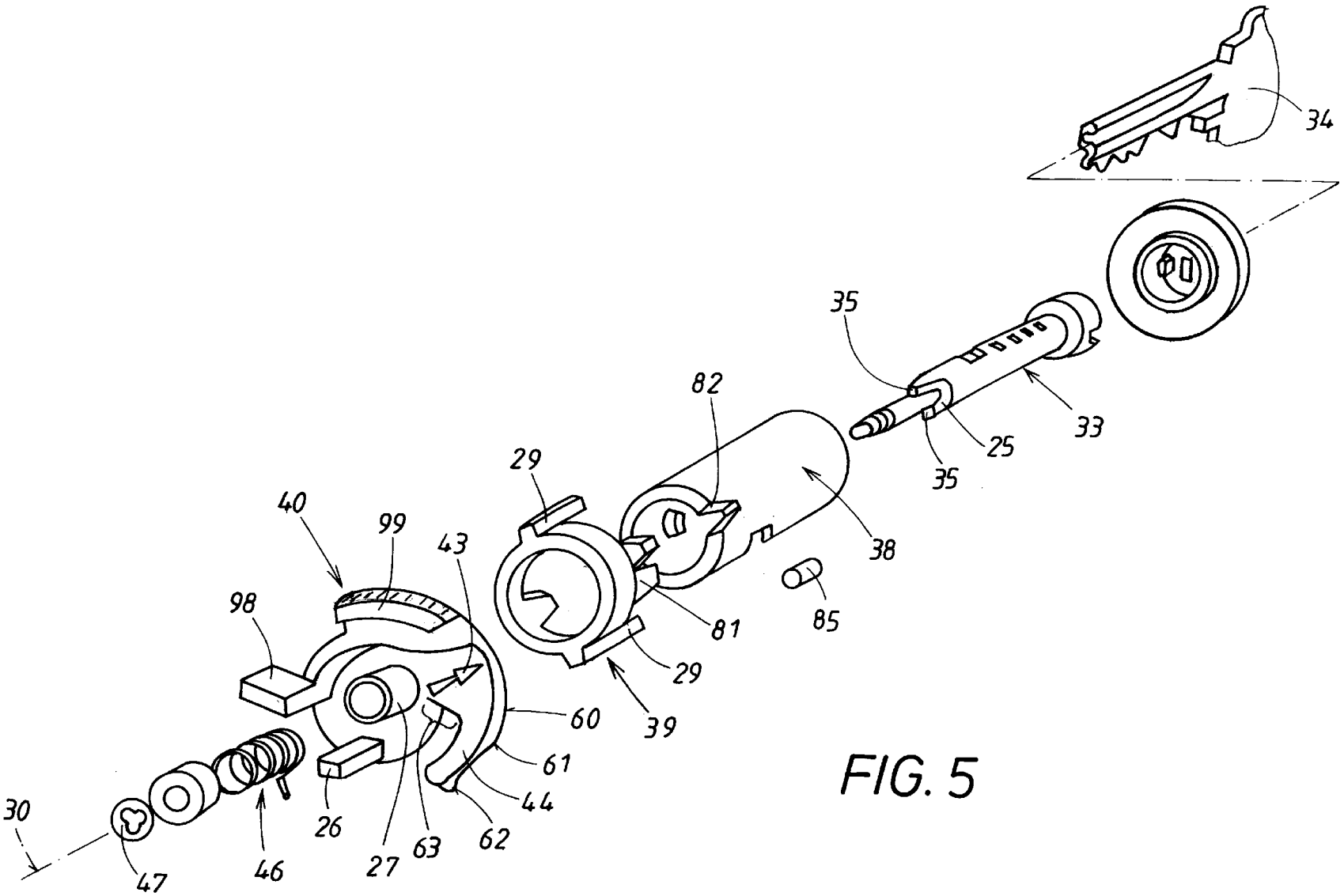

As can be seen from FIGS. 1–6, a locking cylinder is located in a cylindrical part 32 of the lock housing, called "cylinder housing" below. Cylinder housing 32 also defines a cylinder axis 30; this is the axis to which the word "axial" used in the following description refers. The numerous components which can be seen in FIG. 5 are arranged in or on cylinder housing 32; these components include in all cases a cylinder core 33, which can be turned by a properly fitting key 34, and a control element 40. Cylinder core 33 has conventional spring-loaded tumblers 36, only the ends of which can be seen in FIG. 11*b*; because the tumblers are spring-loaded, their ends project into locking channels 37, which can also be seen in FIG. 11*b*, when no key is inserted. In the simplest case, locking channels 37 are integrated directly into cylinder housing 32, but, for the reasons to be given further below, a channel sleeve 38 is used in the present case, as FIGS. 5 and 11*b* show, which is supported so that it cannot move in the axial direction but is still free to rotate. In addition to channel sleeve 38, a slide ring 39 is also provided, which is supported in cylinder housing 32 so that it cannot rotate but is free to move in the axial direction.

Figure 3:
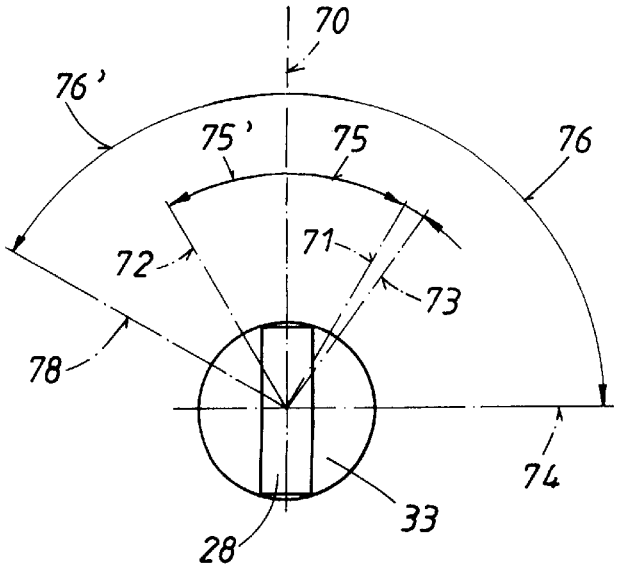
FIG. 3 shows in schematic fashion a front view of the cylinder core of a locking cylinder used in the lock, illustrating the neutral position and the various working positions of interest here.
Figure 4:
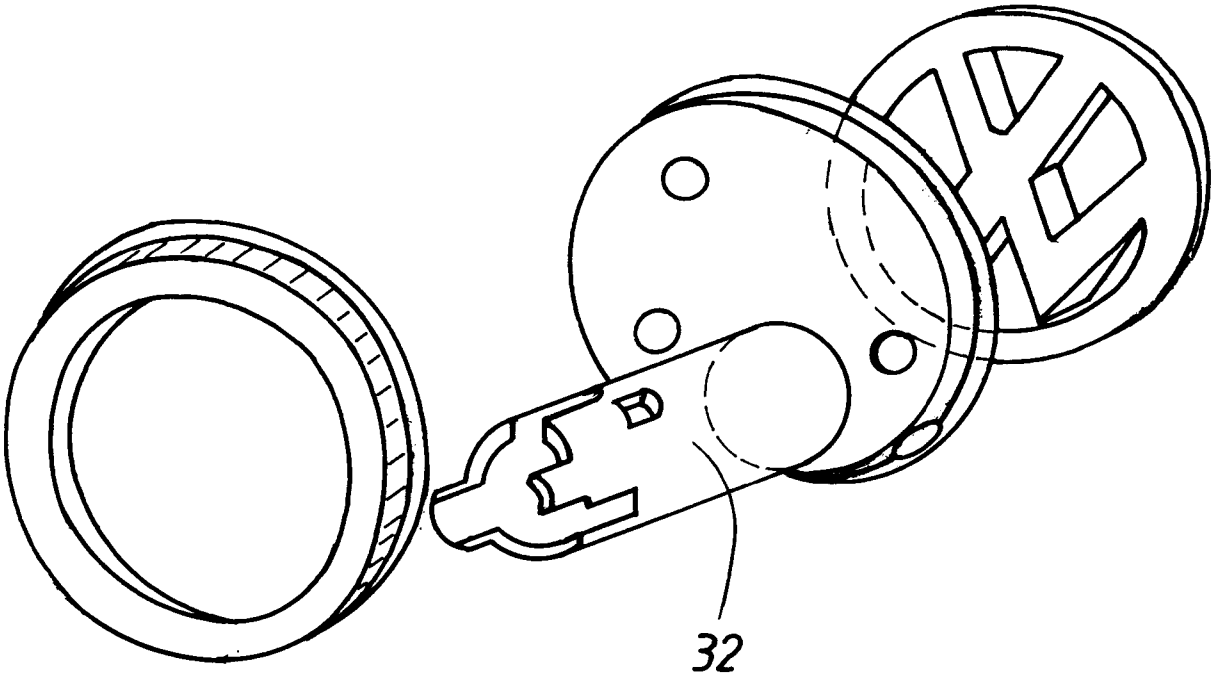
FIGS. 4, 5, and 6 are exploded views of the various components of the lock shown in FIG. 1 before they are assembled.

Components 38, 39, 40 are pushed onto radially set-off sections of cylinder core 33, after which a pulse-compression spring 46, designed as a torsion spring, is installed. Pulse-compression spring 46 acts at the same time as a compression spring, for which purpose it has a helical section. This helical section of spring 46 surrounds a cylindrical shoulder 27 on control element 40. Between them, the two sidepieces 48, 49 of spring 46 hold both a finger 26 of control element 40 and a finger 21 permanently attached to the housing. As a result, cylinder core 33 is held with its key channel 28 in a certain neutral position 70, which is indicated in FIG. 3 by a vertical line. By inserting a properly fitting key 34 into a key channel 28 in cylinder core 33, the core can be turned as desired into any one of the working positions 72, 73, 74 shown in FIG. 3, which will be described in greater detail below.

Finger 21 permanently attached to the housing belongs to an additional housing part 20, which is permanently connected to cylinder housing 32. The design of this part can be seen in FIG. 6. Housing part 20 has a support point 22 for the rotating bolt of a working element 18, which is connected mechanically by way of a tie rod 17 or the like to a locking mechanism 19, indicated in FIG. 7, although in the normal case it can be actuated electrically. In the present exemplary embodiment, these mechanical components 17, 18 are intended to be active only in an emergency.

Figure 1:
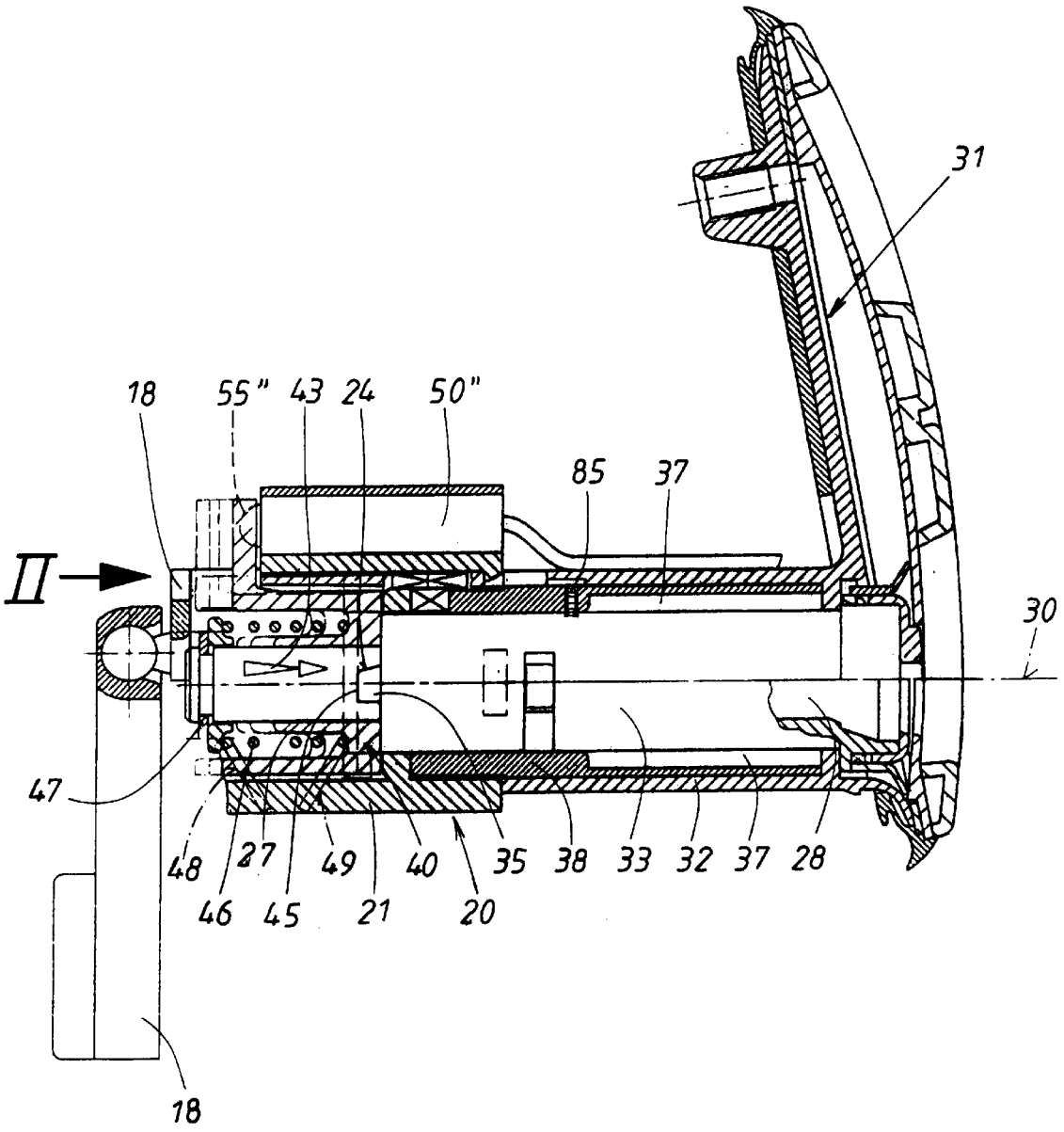
FIG. 1 shows a longitudinal cross section through the lock according to the invention along line I—I of FIG. 2.

A lock washer 47, which engages in a ring-shaped groove in the inside end of cylinder core 33, holds components 33, 38, 39, 40, 46 together and ensures that pulse-compression spring 46 presses a connecting socket 45, visible in FIG. 1, in control element 40 in the direction of force arrow 43 onto a connecting projection 35 on cylinder core 33 and thus normally keeps these two parts engaged. In the present case, two connecting projections 35 and two connecting sockets 45 are provided at diametrically opposing points on components 33 and 40. These connecting parts 35, 45 serve to transmit key rotations 75, 75', 76, 76' of cylinder core 33 shown in FIG. 3 to control element 40.

In the concrete exemplary embodiment, these connecting parts 35, 45 also have an additional function; that is, they have a special profile, which gives them the ability to control the lift of control element 40, which will be explained in greater detail on the basis of FIGS. 8*c*–10*c*. FIGS. 8*a*–13*b* show the relationships of a second embodiment, modified with respect to this one. In FIGS. 8*a*–13*b*, connecting parts 35, 45 have a simple, rectangular profile. The previously mentioned lift control is realized in these figures by a stationary control surface 51 on housing 31 and a lifting surface 41 on control element 40, shown here in a 2-dimensional developed view. This will be discussed in detail further below.

In the exemplary embodiment of FIGS. 1–6, three microswitches 50, 50', 50" are integrated into housing part 20 and thus positioned with respect to control element 40 in a defined manner. In the simplified schematic diagrams of FIGS. 8*a*–13*b*, and also in the previously cited alternative of FIGS. 8*c*–10*c*, these microswitches 50, 50', 50" have been drawn schematically in lock housing 31. There, the associated switching elements 55, 55', 55" for each of these microswitches 50–50" are also drawn individually. In the concrete exemplary embodiment, two of these microswitches, namely, the first 50 and the second 50', are combined into a combination switch 53, which is actuated by a comment actuating element 54. This actuating element 54 can be pivoted in the direction of double arrow 56 of FIG. 6. When it pivots in one direction, it actuates first microswitch 50, and when it pivots in the opposite direction, it actuates the other switch 50'.

Control element 40 serves to actuate all three switches 50–50". In the schematic diagrams of FIGS. 8*a*–13*b*, a switching cam 42 is provided on control element 40; this cam can be moved into various positions 42'–42"', which will be explained later. In the concrete exemplary embodiment, two switching flanks 61, 62, shown in FIG. 5, which fulfill the same function as a switching cam, are provided to produce pivoting motion 56, described above, of common actuating element 54 of combination switch 53. Switching element 55" of the third microswitch 50" works directly with control element 40, namely, with axial end surface 60 of a flange-like part. This effective switching action of end surface 60 of the control element applies both to the concrete exemplary embodiment of FIGS. 1–6 and to the schematically simplified diagrams of FIGS. 8*a*–13*b*. The effective zone for the actuation of switching element 55 is a certain zone 63, namely, here, the radially inner zone of control element 40. In the concrete exemplary embodiment, switching flanks 61, 62 on control element 40, which function as switching cams, are, as FIG. 5 shows, formed on a segment-like shoulder 44 of the flange-like part of control element 40, that is, in a zone offset with respect to the previously mentioned radial zone 63, namely, at a greater radial distance outward from axis 30.

Figure 7:
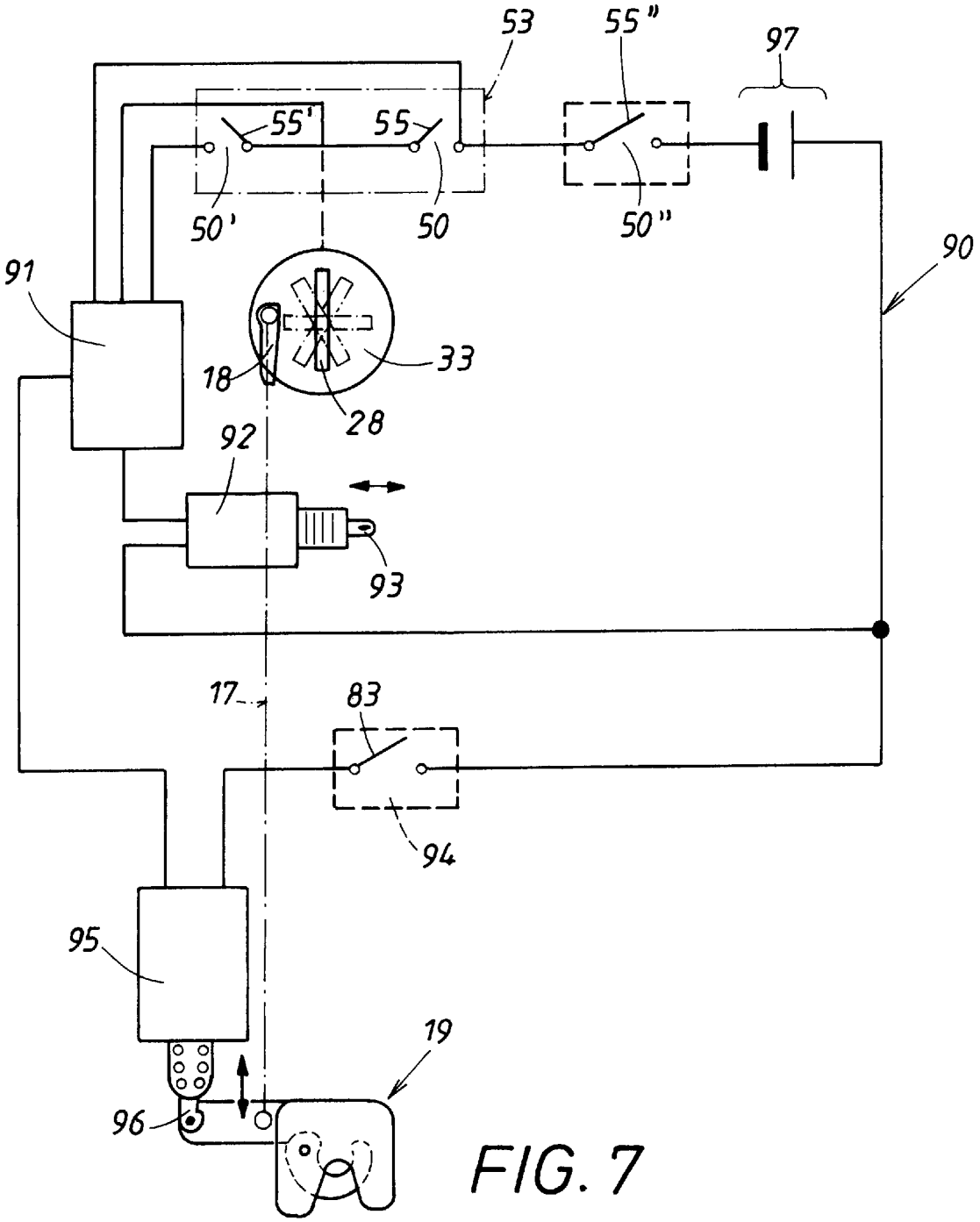
FIG. 7 is an electric circuit diagram of the lock according to the invention, which shows the electrical connections to the associated locking mechanism.

FIG. 7 shows an electrical circuit diagram of the lock according to the invention; only a plan view of cylinder core 33 and locking mechanism 19 are shown in schematic fashion. As can be seen, the three microswitches 50–50" are connected in series in an electrical circuit 90, which is fed from a power source 97, such as a car battery. The two microswitches 50, 50', which are joined together to form combination switch 53, indicated in broken line, act, as a function of the actuation of their switching elements 55, 55', alternately on a complex electronic switching unit 91, by means of which various functions in the motor vehicle such as an anti-theft warning system can be controlled. In the present case, the electronic part of the previously mentioned CL device, from which a large number of CL servo components 92 can be actuated, is also integrated into this electronic switching unit 91. Although only one CL servo component 92 is shown in FIG. 7, other, similar CL servo components 92, all of which are connected to electronic switch unit 91, are provided on all the doors of the motor vehicle and act by way of, for example, extendable and retractable bars 93 on the respective locks provided on these other doors. These other locks are controlled by CL servo components 92 of the CL device in a manner similar to that in which the lock according to the invention is controlled. The lock according to the invention, of which, as stated, only cylinder core 33 is shown in FIG. 7, is located in the tailgate of the motor vehicle.

Figure 15:
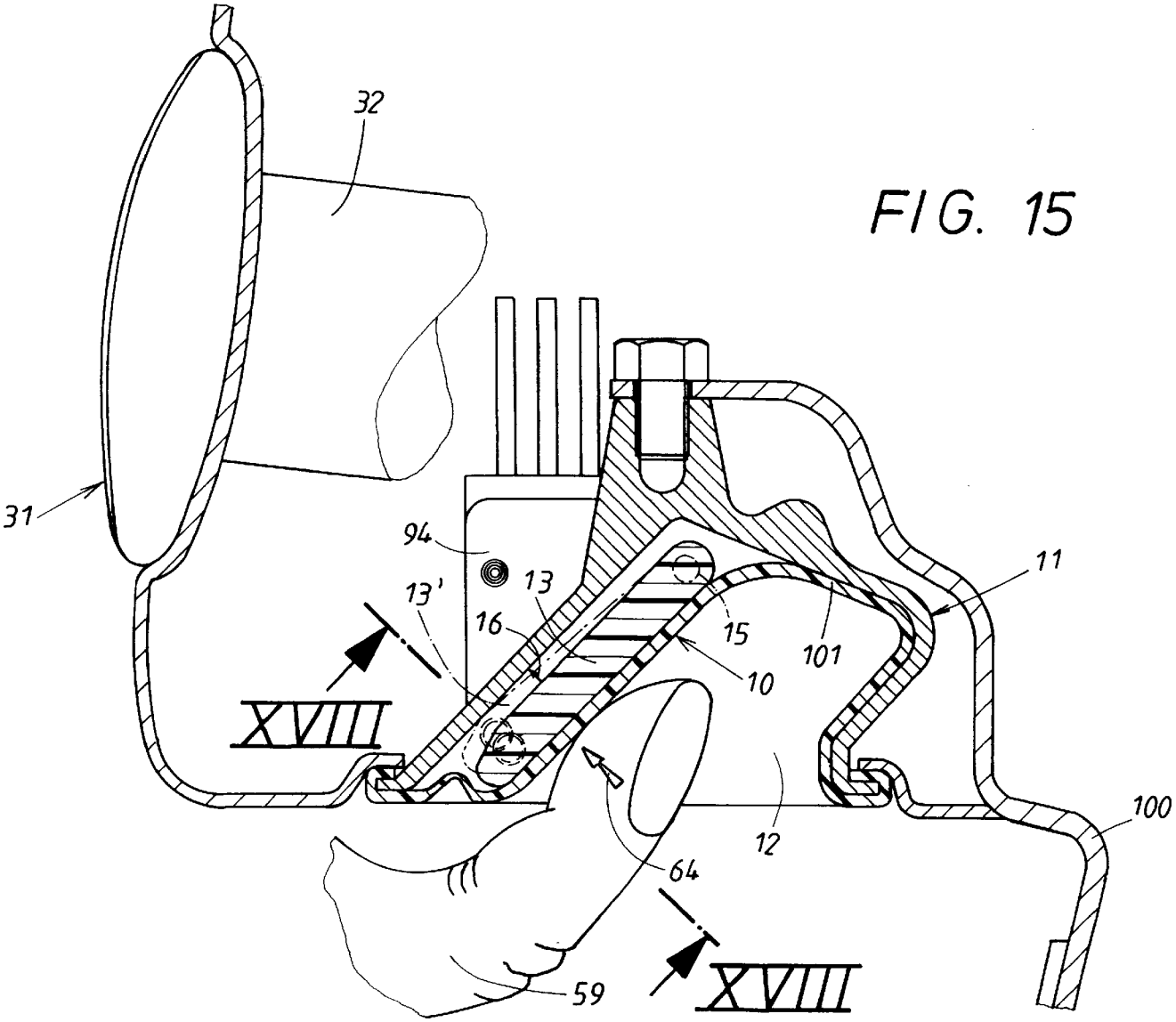
FIG. 15 shows, on an enlarged scale, a cross section through a handle of a special design belonging to the lock in its installed position in the tailgate of a vehicle, the cross section being made along line XV—XV in FIG. 17.

Thus handle 10 shown in FIG. 15 is also located in the tailgate of the motor vehicle. When handle 10 is actuated, the contacts of a switch 94 are closed. This switch is also integrated into electrical circuit 90 of FIG. 7 and acts on an electrical drive 95 of the associated tailgate locking mechanism. Depending on whether the contacts of switch 94 are open or closed, drive 95 moves a working element 96, which acts mechanically on locking mechanism 19, in one direction or the other. In this way, locking mechanism 19 is opened electrically.

Figure 2:
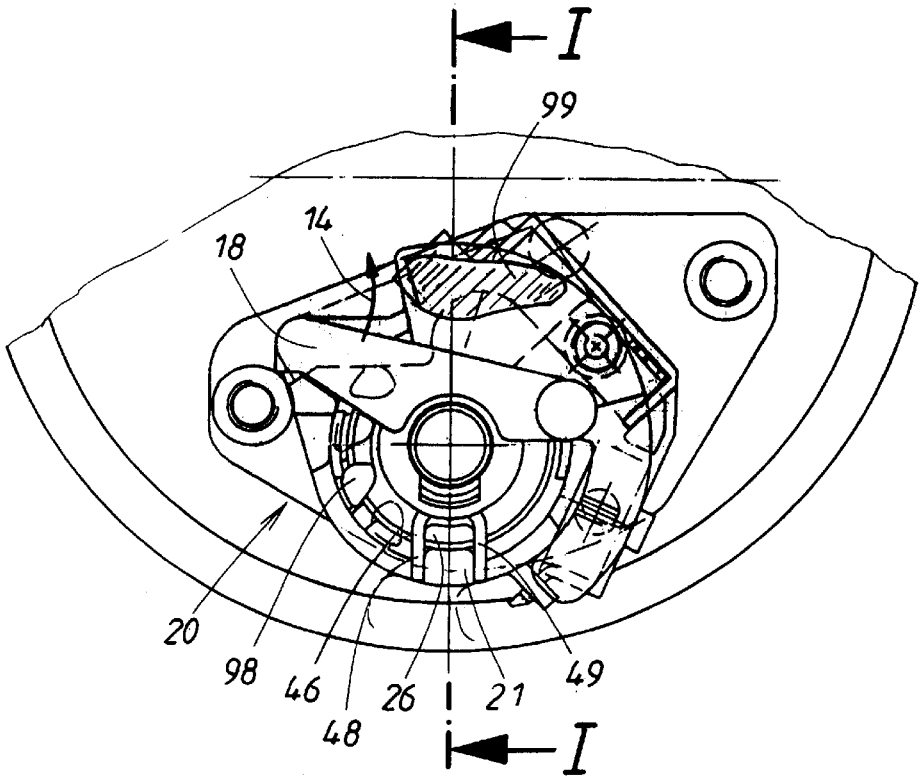
FIG. 2 shows a rear view of the lock shown in FIG. 1, looking in the direction of arrow II.
Figure 6:
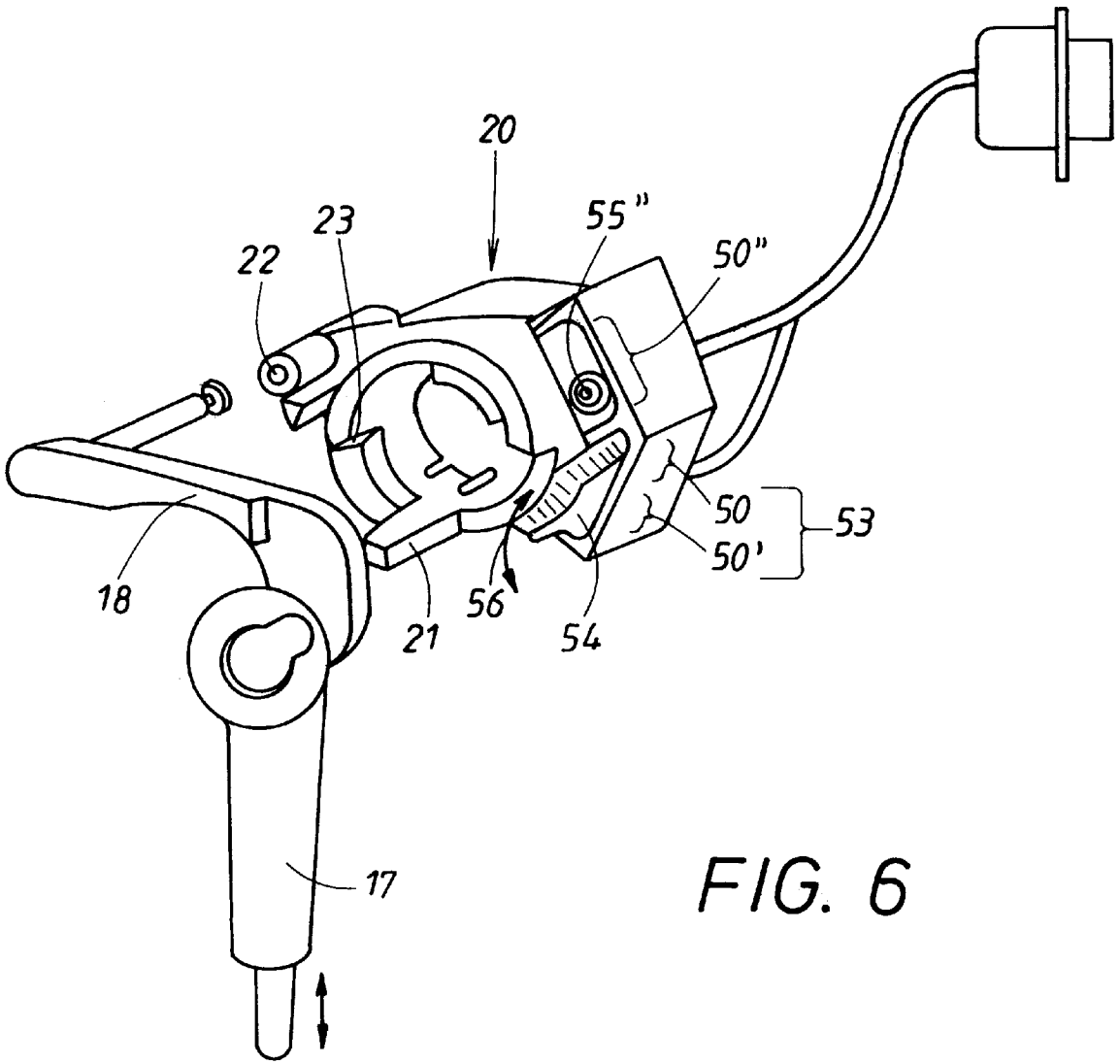

But if the electronic control breaks down because, for example, power source 97 which operates circuit 90 has failed, it is also possible in an emergency for this locking mechanism 19 to be operated mechanically. For this purpose, as already mentioned, pivoting working element 18, shown in FIGS. 1 and 6, is used, which is connected in an articulated manner to tie rod 17, also indicated in broken line in FIG. 7. This mechanical movement of the locking mechanism is brought about by the rotation of control element 40, which acts by way of a lifting cam 98 provided on it, as shown in FIGS. 5 and 2. As a result of the rotation of cylinder core 33 in direction 76' to an end position 78 illustrated there, lifting cam 98 comes up against the lower edge of working element 18, which then executes the working movement illustrated by pivot arrow 14 in FIG. 2. On the flange part of the control element, there is also a stop 99, which, in certain working positions of control element 40, prevents manipulations from bringing about a pivoting motion 14 of working element 18, which will be explained in greater detail below.

The way in which the lock according to the invention works will now be explained in greater detail on the basis of the schematic diagrams of FIGS. 8*a*–13*b*. Here, as already mentioned, rotatable control element 40 is shown schematically as a slide which can be moved longitudinally in the plane of the drawing.

Figure 8A:
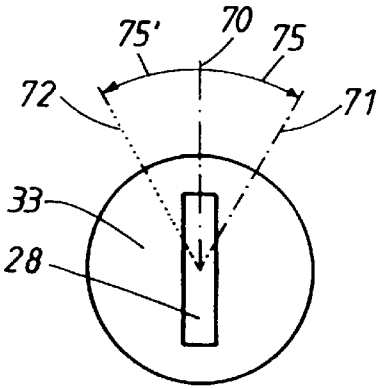
Figure 8B:
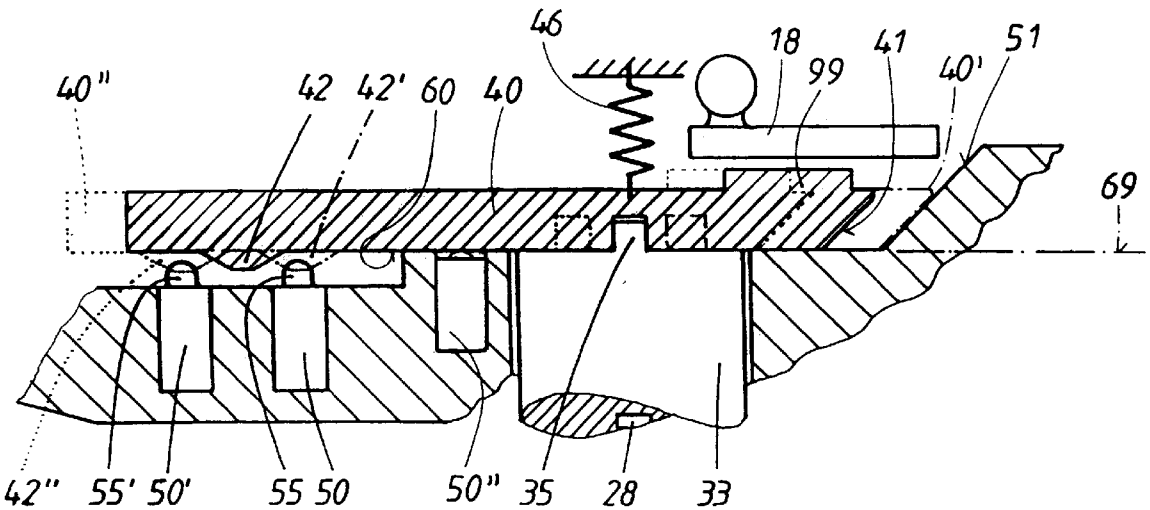

Previously described pulse-compression spring 46 exerts the previously mentioned axial force, illustrated by arrow 43 in FIG. 5, on control element 40 in the direction designed to keep previously mentioned connection 35, 45, located between control element 40 and cylinder core 33, engaged. When the control element is rotated into rotational position 40' of FIG. 8*b*, illustrated here as a longitudinal displacement, this force 43 pushes a lifting surface 41 on control element 40 against control surface 51 of housing 31. Pulse-compression spring 46, however, as already mentioned, is also a torsion spring, which holds control element 40 with its actuating cam 42 in a defined, normal position according to FIG. 3. This normal position is also drawn in solid line in the diagram of FIG. 8*b*, to be described in greater detail further below. As already mentioned, spring sidepieces 48, 49 of pulse-compression spring 46 ensure that this normal position is maintained. FIG. 8*a* shows a front view of cylinder core 33 in its neutral position, which is illustrated by an auxiliary line 70, determined by the position of key channel 28. The position of control element 40 in this neutral position 70 has been drawn in solid line in the diagram of FIG. 8*b* and is called the "normal" position in the following. In this normal position, actuating cam 42, provided on control element 40, is in a neutral position between the two microswitches 50, 50'.

FIG. 8*a* shows two working positions 71, 72, of cylinder core 33, one on either side of neutral position 70. These two working positions can be reached by rotating the key inserted into cylinder channel 28 out of neutral position 70 and in the directions indicated by opposing rotation arrows 75, 75'. In the case of a rotation 75 of cylinder core 33 to first working position 71 in FIG. 8*a*, control element 40 is carried along also by virtue of connection 35, 45, which is engaged.

The control element thus leaves normal position 40, drawn in solid line in FIG. 8*b*, and arrives in first working position 40', shown in broken line. As a result, actuating cam 42 is also moved out of its normal position and into first working position 42', also shown in broken line, and thus actuates switching element 55 of first microswitch 50, which then turns on the previously mentioned anti-theft warning system connected to the circuit and reverses the settings of CL elements 92 by way of CL device 91. In working position 42', therefore, switch 55 is closed, as shown in the previously described circuit diagram of FIG. 7.

Not only now but even before this, third microswitch 50" is also in a continuously closed position, because, as already mentioned, end surface 60 of control element 40 depresses switching element 55". By the closing of switch 50, a voltage pulse is sent via circuit 90 to electronic switching unit 91. In accordance with the control program provided there, the electrical connection to drive 95 of the associated locking mechanism is turned off in this case. This means that closing previously mentioned switch 94 belonging to handle 10 has no effect. The actuation of handle 10 of FIG. 15 therefore does nothing; the associated locking mechanism 19 cannot be released. The associated working position 71 of cylinder core 33 of FIG. 8*a* thus turns out to be the "secured position" of cylinder core 33.

If the key is now let go after reaching secured position 71, pulse-compression spring 46 first guides the control element out of first working position 40' back into normal position 40, shown in solid line in FIG. 8*b*. Because connection 45, 35 remains engaged as before, cylinder core 33 is also guided indirectly, i.e., by way of control element 40, back into the normal position shown in solid line in FIG. 8*b*.

This situation does not change until cylinder core 33 is moved by the key, as shown in FIG. 8*a*, in direction of opposing arrow 75' relative to neutral position 70 into a second working position 72. Because of connection 35, 45, which is still engaged in this case, the control element is moved out of its neutral position 70 of FIG. 8*b* into second working position 40", shown here in dotted line. On transition into this second working position 72, the control element with its actuating cam arrives in the second working position designated 42" in FIG. 8*b*. As a result, switching element 55' of second microswitch 50' is actuated. When, in the circuit diagram of FIG. 7, switch 50' closes, a voltage pulse is sent to the second input of electronic switching unit 91, because third microswitch 50" remains closed in this case also. As a result, an anti-theft warning system can be turned off again, and the CL device is reversed. At the output of electronic switching unit 91, an actuating pulse is generated, which initially reverses the various CL actuators 92. In addition, a voltage is applied continuously to electric drive 95 of the locking mechanism. When handle 10 is now actuated and thus the associated switch 94 is closed, working element 96 is moved by drive 95, and associated locking mechanism 19 in the tailgate of the vehicle is opened. Both the tailgate and all the doors can now be opened by the actuation of the handles in question. This working position 72 therefore turns out to be the "unsecured" position of the lock mentioned at the beginning. If, after rotation 75', the key is now released again, pulse-compression spring 46 and the control element work together with connection 45, 35 to return cylinder core 33 to its neutral position 70 again.

Figure 9A:
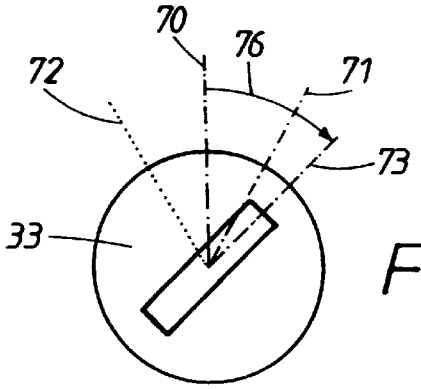
Figure 9B:
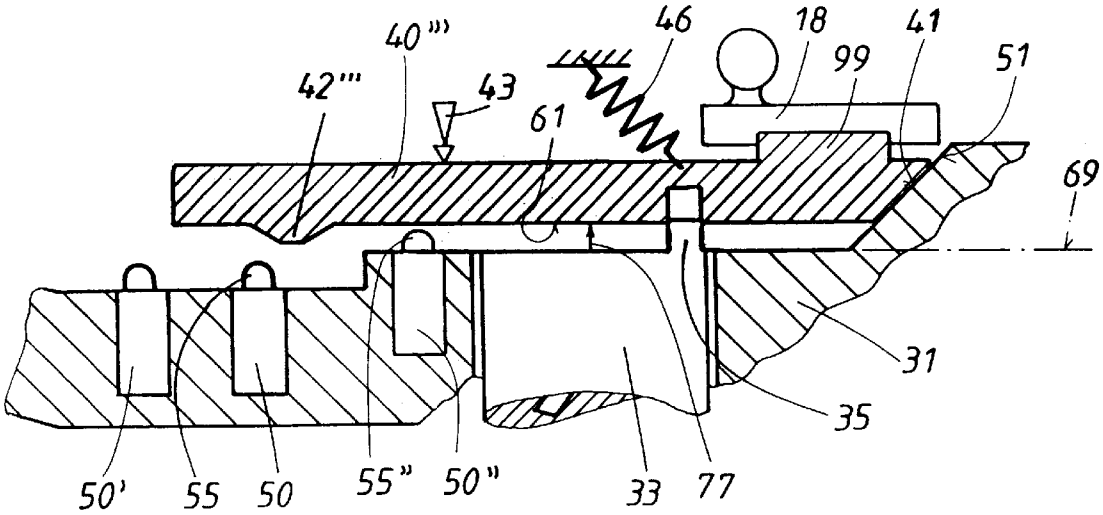
Figures 10A, 10B:
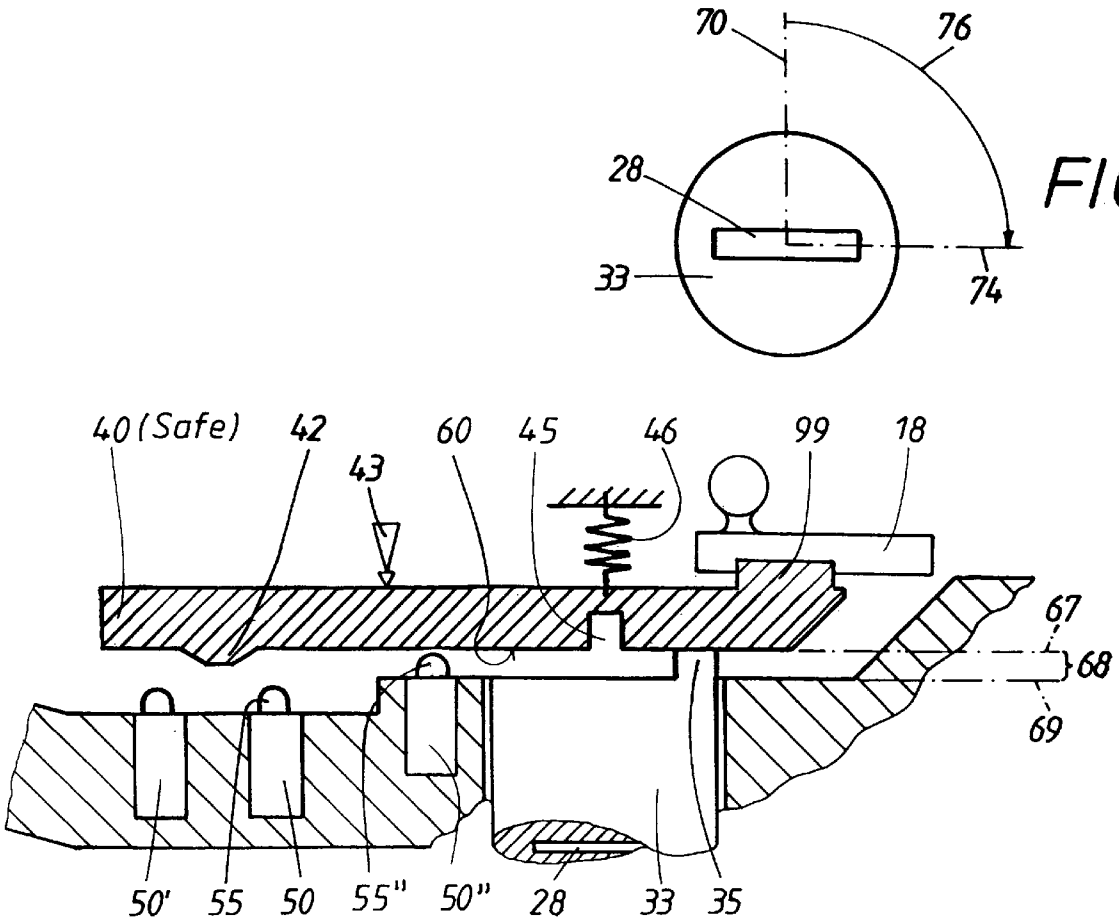

FIG. 9*a* again shows a front view of cylinder core 33, but this time in a limit position, designated 73, a certain distance away from previously described secured position 71, as indicated by the greater length of rotational arrow 76. At this rotational limit, control element 40 is in a limit position 40"', as indicated in the diagram, which is drawn in a manner similar to FIG. 9*b*. The previously mentioned axial control means between lock housing 31 and control element 40 now become active. Lifting surface 41 of the control element has moved up along control surface 51 on the housing. This is indicated in FIG. 9*b* by an axial lifting arrow 77. As a result of this lifting motion 77 of control element 40"', connecting projection 35 of cylinder core 33, which, although held permanently in the axial direction, is nevertheless free to rotate, has become almost completely disengaged itself from connection socket 45 of the axially moving control element. When now the key is used to rotate cylinder core 33 past this limit position 73 of FIG. 9*a* into a third working position 74, as shown in the front view of FIG. 12*a*, connecting projection 35 and connection socket 45 become completely disengaged from each other as soon as limit position 73 is left behind. The control element is now free and, as FIG. 10*b* illustrates, it is automatically carried back into its normal position 40 by the action of pulse-compression spring 46. Nevertheless, raised axial position 77 of the control element remains in effect for the following reason.

As already stated, pulse-compression spring 46 also exerts a compressive force, illustrated by force arrow 43, which is also shown in the diagrams of FIGS. 9*b* and 10*b*. In FIG. 9*b*, therefore, the control element rises against the action of this force 43 in the direction of lifting arrow 77 up as far as limit position 40"'. After disengagement has occurred, this force 43 remains in effect even after the control element of FIG. 10*b* has returned to normal position 40, but now control element 40 is supported axially by the end surface of connecting projection 35 on axially immovable cylinder core 33. In FIG. 10*b*, control element 40 is located in a plane 67, which is determined by the height of connecting projection 35, this plane being referred to here as the "disconnection plane". It is offset with respect to the preceding connection plane 69 by axial distance 68. As can be derived from FIG. 10*b*, however, cylinder core 33 remains in this new working position 74, in which the key can be withdrawn. Tumblers 36 move into an additional locking channel 37 provided there and therefore lock the mechanism in working position 74. This working position is the "safe secured" position, already mentioned several times before, which is to be referred to here in brief as the "safe" position. Unusual circumstances are present here in several respects.

First, associated handle 10 remains inoperative, as previously mentioned, because first microswitch 50 was actuated beforehand but not microswitch 50'. The CL device also remains in its control position. As a result of the special design of the CL device in the present exemplary embodiment, the lock is secured in yet another way. In disconnection plane 67, control element 40 has released switching element 55" of third microswitch 50". Switch 50" is therefore in its open position according to the circuit diagram of FIG. 7. Circuit 90 is therefore interrupted between power source 97 and electronic switching unit 91. An actuation of switch 94 by manipulation of handle 10 is therefore completely without effect. This is also true in a purely mechanical sense.

As can be seen from FIG. 10*b*, previously mentioned stop 99 on control element 40 has been shifted axially in disconnection plane 67 to such an extent that it now projects into the working path of mechanical working element 18. The use of break-in tools to manipulate working element 18 therefore has no effect whatever. In contrast, in the axial position of control element 40 in connection plane 69 shown in FIG. 8*b*, stop 99 is out of the working path of working element 18. In this case, a key can turn the locking mechanism all the way to lock actuation position 78 shown in FIG. 3 as rotation 76'. Therefore, the locking mechanism can now be opened by means of the key.

Even in limit position 40''' of FIG. 9*b*, switching cam 42''' is already a certain axial distance 68 away from switching element 55 of microswitch 50, for which reason, when the control element is later returned by spring 46 to the "safe" normal position 40 of FIG. 10*b*, the switching cam moves in disconnection plane 67. Thus the switching cam arrives in its normal position 42 shown in FIG. 9*b* at a certain axial distance 68, which is determined by the difference between the height of the two planes 67, 69. Although cam 42 moves back across microswitch 50 as it returns to its "safe" normal position, it does so without actuating switching element 55 of microswitch 50. The previous activation of the anti-theft warning system which occurred on transition into secured position 71 therefore remains in effect, and microswitch 50 is not actuated again.

In analogy to FIGS. 8*b*, 9*b*, and 10*b*, FIGS. 8*c*, 9*c*, and 10*c* show alternative designs pertaining to the previously described lift control of control element 40 between its two planes 69, 68. In other respects, the same relationships as those in FIGS. 8*b*, 9*b*, and 10*b* are present. It is sufficient to discuss only the differences; otherwise, the description given above applies here as well.

In this alternative, connection parts 35, 45 have a special profile; namely, one flank 25 of connecting projection 35 is designed with a slant, and connecting socket 45 also has a correspondingly slanted inside surface 24. In addition, a stationary stop 23 is provided on lock housing 31. These profile shapes are also found in the concrete embodiment according to FIGS. 1–6. It is possible to recognize the slanted inside surface 24 of socket 45 in FIG. 1, slanted flank 25 on connecting projection 35 in FIG. 5, and stop 23 on housing part 20 in FIG. 6.

Figure 8C:
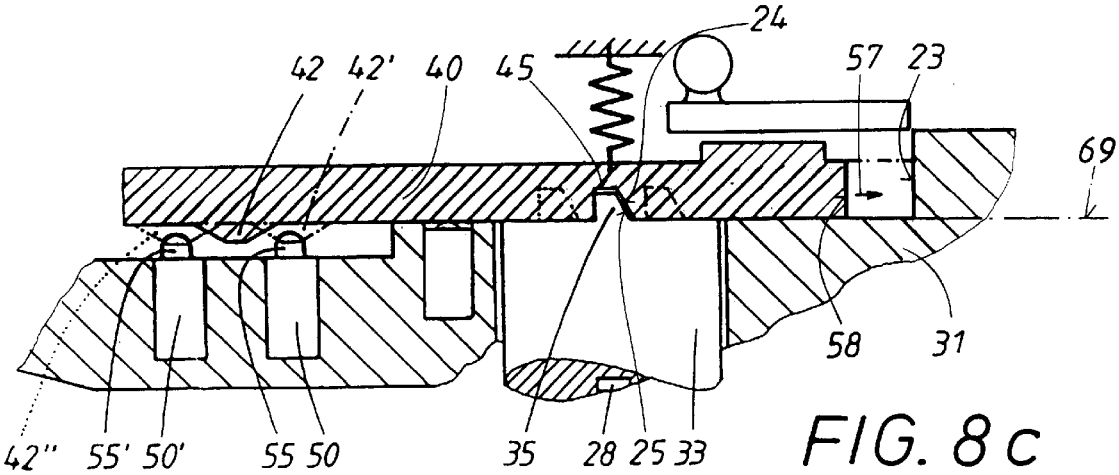
Figure 9C:
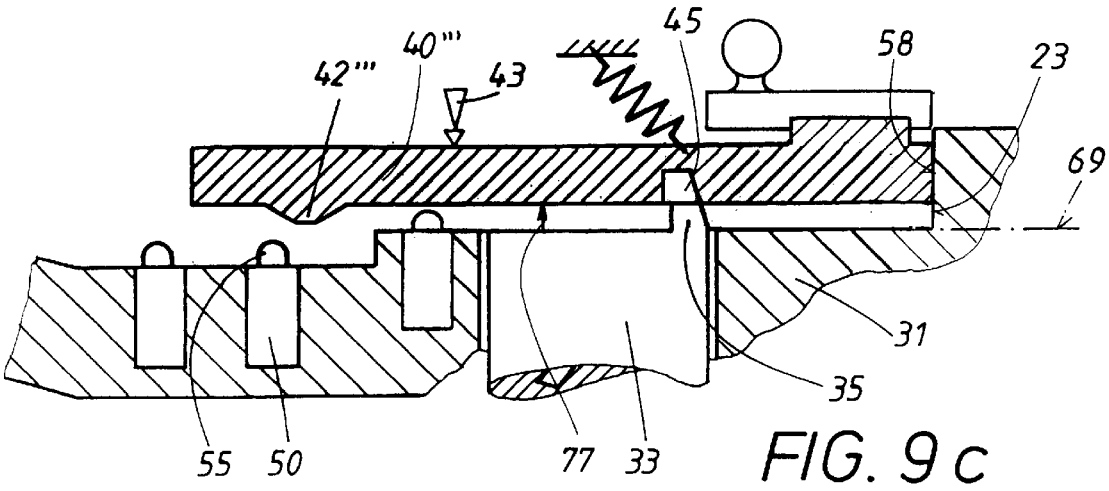
Figure 10C:
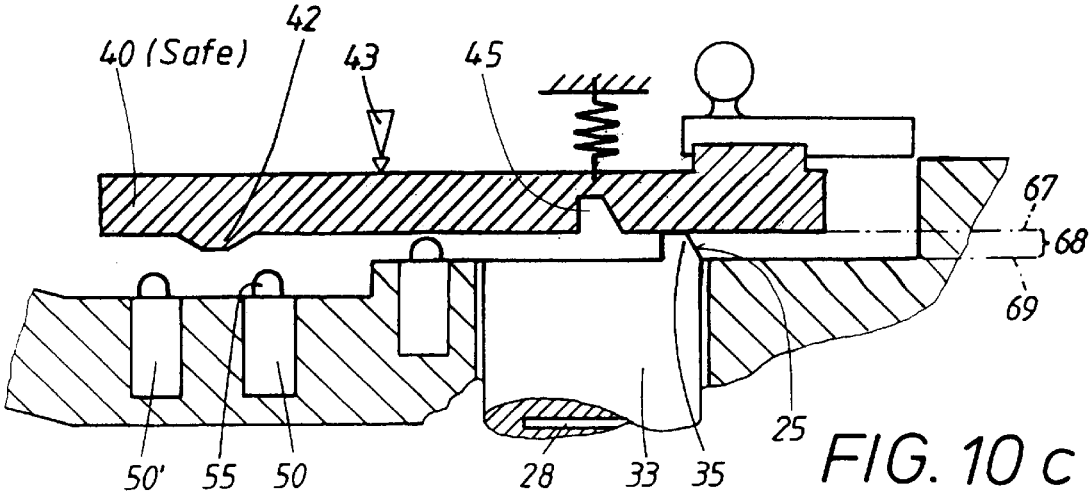

When the key is used to rotate cylinder core 33, connection 35, 45 causes control element 40 to be carried along as well, as indicated in FIG. 8*c* by motion arrow 57. As this is happening, edge 58 of control element 40 comes up against stop 23 on the housing, for which reason no further movement 57 of control element 40 is possible. As cylinder core 33 continues to rotate, control element 40 slides by its inside surface 24 up along slanted flank 35 of the connecting element. In limit position 40''' of the control element shown in FIG. 9*c*, the lifting motion 77 already described in conjunction with FIG. 9*b* has occurred, and this remains in effect even after cylinder core 33 has been rotated further into "safe" position 74 already described. Then, as FIG. 10*c* shows, control element 40 is located in disconnection plane 67. The angle of rotation is defined exactly by the contact between control element edge 58 and housing stop 23, this being the angle at which lifting motion 77 of the control element out of connection plane 69 into the disconnection plane 67 begins.

FIGS. 11*a* and 11*b* present the same relationships as those shown in FIGS. 10*a* and 10*b*. The only difference is that FIG. 11*b* also explains the way in which components 38, 39 work, which have already been explained in conjunction with FIG. 5. FIGS. 11*b*–14*b* show a so-called overload safety on locking cylinder 33. Slide ring 39 is guided by, for example, radial knobs 29, which move along corresponding longitudinal grooves 79 in housing 31 of the lock; thus the ring is free to move axially but cannot rotate. Channel sleeve 38 is installed so that it cannot move in the axial direction but free to rotate in lock housing 31. At their two facing ends, slide ring 39 and channel sleeve 38 have a complementary lift-out profile 81, 82. This consists, as can be seen in FIG. 5, of an approximately trapezoidal recess 82 in channel sleeve 38 and a complementary elevation 81 on slide ring 39. It is advisable to provide two lift-out profiles 81, 82 of this type at diametrically opposing points. As an additional component of this overload safety, a compression spring can be provided, but in the present case axial force 43 already being produced by pulse-compression spring 46 is used, which is also shown in FIGS. 11*b* and 12*b*. Thus spring 46 fulfills yet another, third, function.

As long as the proper key has not been inserted in key channel 28 of FIG. 11*a*, previously mentioned tumblers 36 engage in locking channel 37 of channel sleeve 38, as shown in FIG. 11*b*, and thus ensure a rotation-proof connection between cylinder core 33 and channel sleeve 38. But when cylinder core 33 is rotated not by the proper key but rather by a break-in tool in the direction of arrow 86, engaged tumblers 36 cause channel sleeve 38 to rotate also, and therefore, once a certain limit load is exceeded, lift-out profile 81, 82 is lifted against the force of spring 43. This situation is shown in FIG. 12*b*. Now end surface 89 of slide ring 39 opposite lift-out profile 81 supports control element 40.

Lift-out profile 81, 82 can produce more lift 65 than that which corresponds to previously mentioned lifting motion 77 between connection plane 68 and disconnection plane 67. As a result of axial lift 65 shown in FIG. 12*b*, control element 40 arrives in a third axial plane, which is to be referred to here as the "overload safety plane". The safe position of control element 40 remains therefore ensured even in the event of a break-in. As FIG. 12*a* illustrates, cylinder core 33 can be rotated by a break-in tool in the direction of rotation arrow 86 without interfering with the uselessness of any attempt to actuate the handle; the associated locking mechanism remains closed as before.

FIGS. 13*b*–14*b* show additional features of the previously described overload safety. Channel housing 38 is provided here with an opening 84, through which a synchronization element, designed here as a roller 85, extends. Lock housing 31 has a first recess 87 for one end of roller 85, and the circumferential surface of cylinder core 33 has a second recess 88 for the opposite end of roller 85. In safe position 74 of cylinder core 33, shown in FIG. 14*a*, brute-force rotation 86 by means of a break-in tool produces the situation shown in FIG. 14*b*, which is a partial cross section along line XIVb—XIVb in FIG. 13*b*. If, as already stated in conjunction with FIG. 12*b*, cylinder core 33 is connected by engaging tumblers to channel sleeve 38 in a rotation-proof manner, then these parts will rotate together with each other, as rotation arrow 86 in FIG. 14*b* indicates. Roller 85 thus leaves recess 87 in the housing and travels around until it arrives in recess 88 in the core.

FIG. 14*a* shows the relationships at the same point as that of FIG. 14*b* when the situation explained in conjunction with FIGS. 8*b*–10*b* is present; here cylinder core 33 is being rotated by a properly fitting key. In this case, tumblers 36, already described several times in conjunction with FIG. 11*b*, are "sorted" into their assigned positions around the circumference of cylinder core 33. Channel sleeve 38 cannot rotate, because it is held by roller 85. The roller now escapes into housing recess 87 but still extends to a sufficient extent into opening 84 to prevent channel sleeve 38 from rotating in lock housing 31. Roller 85 releases the other recess 88 in FIG. 14*a* and therefore allows previously described rotation 76 of cylinder core 33 with respect to its channel sleeve 38.

As indicated in FIG. 15, handle 10 consists of a spring-loaded grip flap 13, which is recessed into a grip trough 12 of a handle housing 11. This handle housing 11 is integrated into a tailgate 100, in which lock housing 31 is also located. Grip flap 13 is supported by a pivot axis 15 in handle housing 11 so that it is free to pivot. When pressure is exerted by a hand 59 in the direction of arrow 64, the flap can thus pivot in the direction of arrow 16 into position 13' indicated in dotted line.

Figure 16:
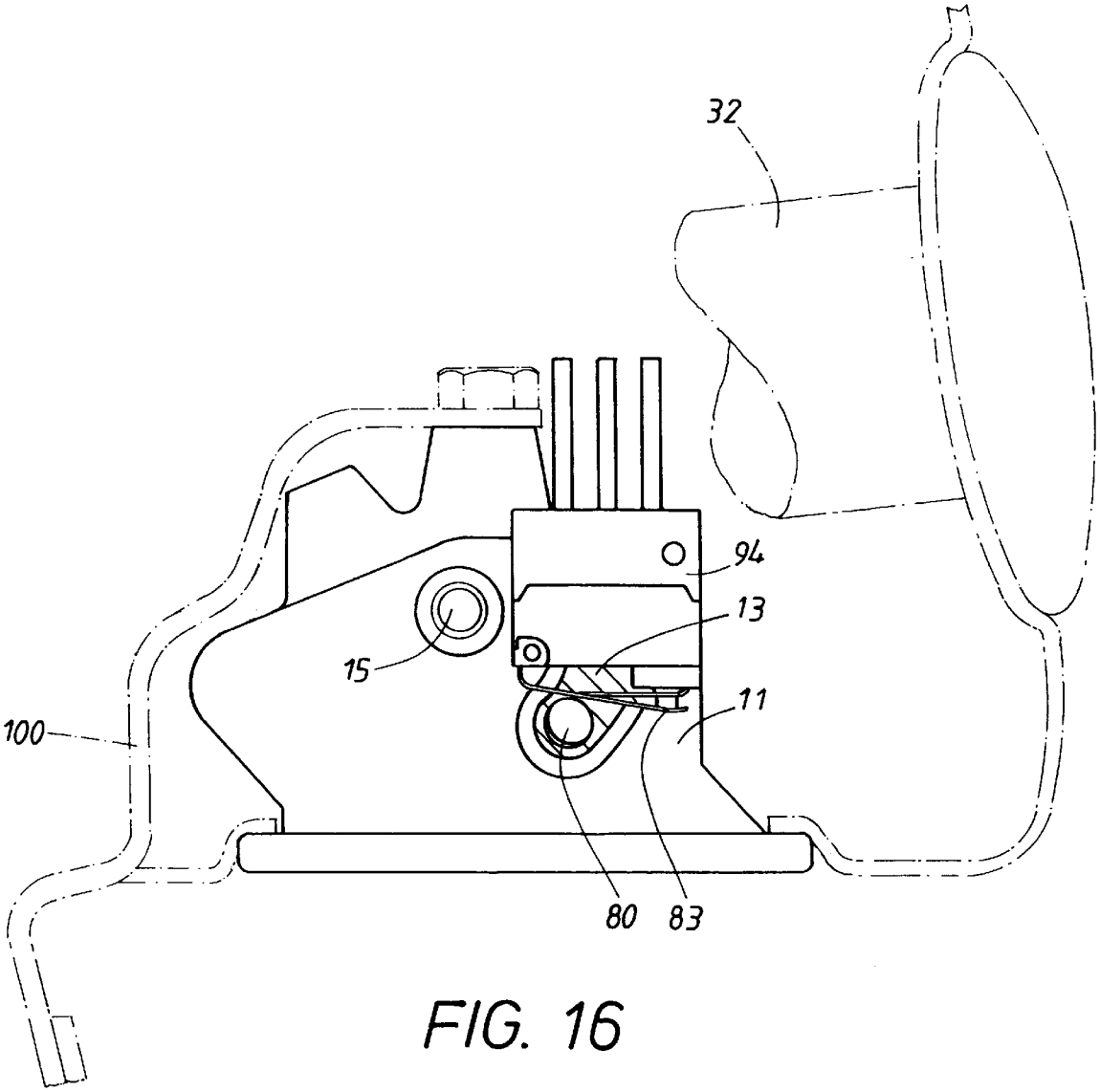
FIG. 16 shows a rear view of the handle of FIG. 15 with the associated switch.
Figure 17:
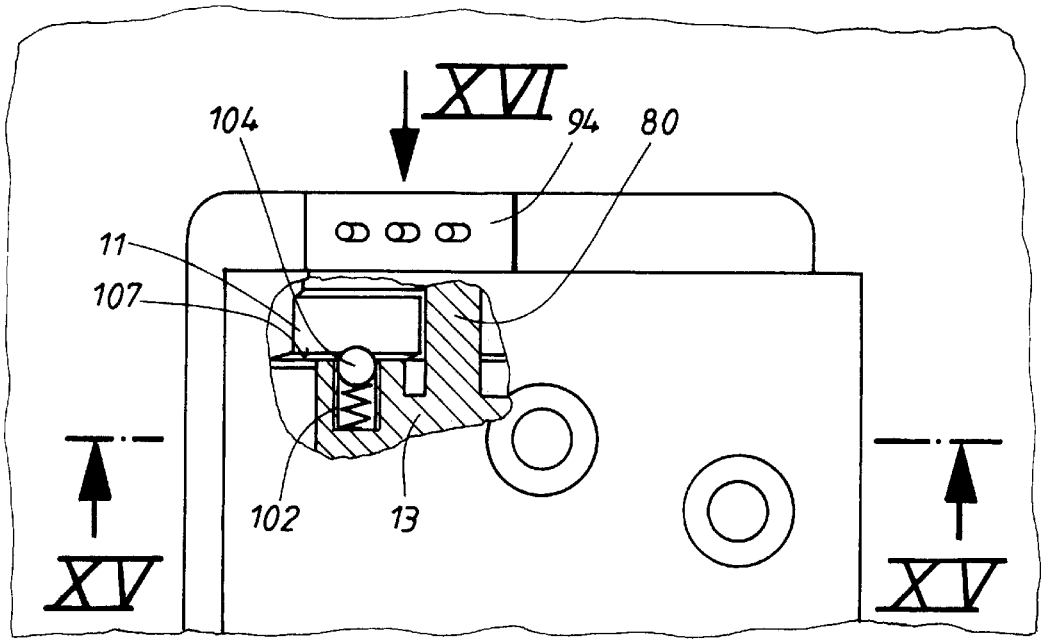
FIG. 17 shows a rear view, partially cut away, of the handle of FIG. 15.

As FIGS. 16 and 17 show, grip flap 13 is provided with lateral pin 80, which projects out of housing 11. On the external surface of housing 11, a switch 94 is installed; pin 80 cooperates with switching element 83 of this switch. The switching movements explained in conjunction with the circuit diagram of FIG. 7 thus take place, and these lead to the consequences described previously. Grip flap 13 and the inside surface of housing 11 are lined with a rubber skin 101, which guarantees a water-tight installation of entire handle 10 in trough 12 of tailgate 100.

Figure 18:
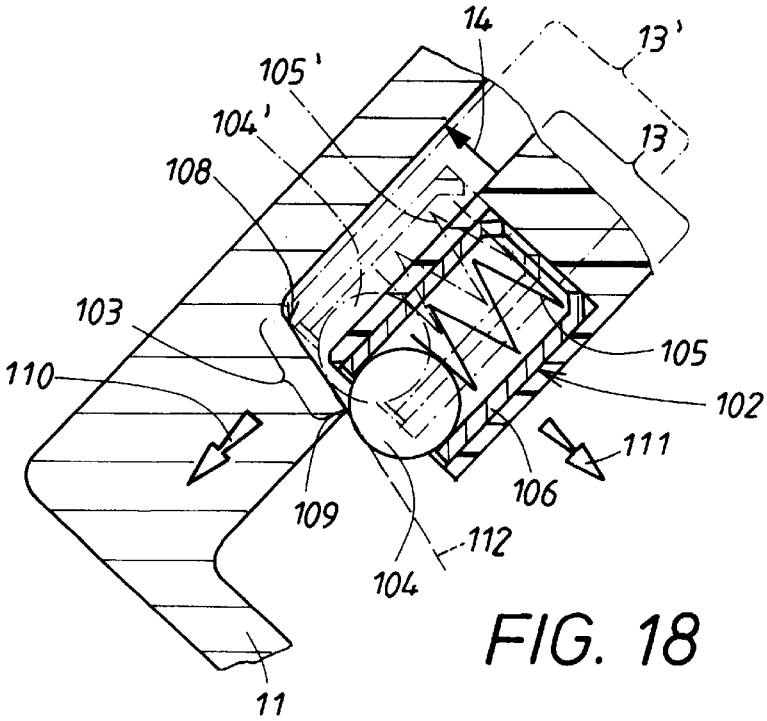
FIG. 18 shows, on a greatly enlarged scale, an additional detail of the handle shown in FIG. 15.

Grip flap 13 is held by a latching device 102, 103 in its initial position shown in solid line in FIG. 15. This latching device 102, 103, however, also fulfills another, different function, which is made clear on the basis of FIG. 18. The latching device comprises, first, an elastic latching element 102, which here consists of a spring-loaded ball 104. This ball 104 is acted upon by a compression spring 105, which is integrated along with ball 104 into a cup-shaped housing 106. As can be seen especially clearly in FIG. 17, the entire assembly 104, 105, 106 is recessed into a lateral edge 107 of grip flap 13, as a result of which spring-loaded ball 104 faces the side wall of handle housing 11. A lateral step 108 is located there. The previously mentioned unlatch position 13' of the grip flap, shown in dotted line, is also illustrated in FIG. 18, and an arrow 14 of the pivoting motion is also indicated. Lateral step 108 serves as a counter-latching element 103 for previously mentioned elastic latching element 102.

It is important to note that this counter-latching element 103 has a slanted surface, which extends at an angle to pivoting motion 14. This slant is drawn in dotted line in FIG. 18, is designated 112, and will be referred to in the following as the "slanted surface". This slant ensures that, when elastic element 102 is in starting position 13 of the grip flap, it is under less load than when it is in actuation position 13'. Because latching element 102 is always trying to achieve maximum release, it will try to travel as far as possible down along slanted surface 112. Maximum load release is achieved as soon as spring-loaded ball 104 has emerged completely from latch housing 106 at step edge 109. Thus, elastic latching element 102 ensures that the grip flap is held in its starting position 13 of FIG. 18. This is what accounts for the latching action.

When the grip flap is moved into its actuating position 13', the ball is pressed into recessed position 104', shown in dotted line in FIG. 18. The compression spring is pushed into compressed position 105' of FIG. 18. Thus, a force is produced which acts on pivoted grip flap 13' in the direction of arrow 110 of FIG. 18. This force produces a force component 111 on slanted surface 112 of handle housing 11; this force component acts in the direction opposite that in which the grip flap has been pivoted, thus exerting a restoring moment on pivoted-in grip flap 13'. This restoring moment therefore tries to move the grip flap into its starting position 13 of FIG. 18. Latching device 102, 103 designed in accordance with the invention is therefore simultaneously a restoring means for grip flap 13.

This double function of latching device 103, 104 makes possible a space-saving design and also reduces the number of components required. In addition, the combination of restoring means and latching element makes it possible to produce a snapping sound when grip flap is actuated 14 between positions 13 and 13'. This sound gives the user an audible signal that he/she has successfully actuated switch 94. This double function has its own inventive significance, independently of the lock of FIGS. 1–14*b*.

What is claimed is:

1. Lock for doors, hoods, tailgates (100), or the like, especially of vehicles such as motor vehicles, with a lock cylinder, the cylinder core (33) of which can be rotated by a properly fitting key (34) out of a neutral position (70), determined by a pulse spring (46), into three different working positions (71, 72, 74), namely, an unsecured position (72), a secured position (71), and a safe-secured position (74);

with a handle (10), which, when actuated while the lock is in the unsecured position (72), opens a locking mechanism connected (17, 18) to it, but which cannot actuate the locking mechanism when the lock is in the secured position (71) or in the safe position (74);

with at least one microswitch (50, 50'), which, when actuated, controls mechanical or electrical components;

and with a switch actuator (42), which is carried along by the cylinder core (33) when the core is rotated (75, 75', 76) by the key, and which, when the cylinder core (33) passes between the neutral position (70) and one of the working positions (71, 72), actuates the microswitch (50);

wherein the switch actuator (42) is seated on a control element (40), which, upon rotation (75, 75', 76) of the cylinder core (33) over different angular ranges by the key, is shifted by control surfaces (41, 51; 24, 25; 81, 82) optionally into one of at least two planes (69, 67, 66) separated by an axial gap (68), namely, into at least a connection plane (69) and a disconnection plane (67);

in each of which planes the control element (40) can be moved between a normal position (40) corresponding to the neutral position (70) of the cylinder core (33) and one or more working positions (40', 40") corresponding to the working positions (71, 72, 74) of the cylinder core (33);

where the control element, when in the connection plane (69), is connected nonrotatably to the cylinder core (33), and where its switch actuator (42) can contact and actuate the microswitch (50, 50') at small degrees of rotation (75, 75') of the key;

whereas, at large degrees of rotation (76), the control element (40) arrives by means of the axial control surfaces (41, 51; 24, 25) in the disconnection plane (67), in which the control element (40) is disengaged from the cylinder core (33), and where its switch actuator (42) now moves past the microswitch (50) on a level a certain distance (68) away, thus leaving the switch unactuated;

and in that the pulse spring (46) is always connected to the control element (40) and always tries, in all planes (69, 67) and in all working positions (40', 40"), to move the control element into its normal position (40).

2. Lock according to claim 1, wherein two microswitches (50, 50') are provided; and in that, while the control element is in the connection plane (69), its switch actuator (42) actuates:

one microswitch (50) as the control element moves from its normal position (40) into the first working position (40'), corresponding to the secured position (71) of the cylinder core (33); and the other microswitch (50') as the control element moves from its normal position (40) into the second working position (40"), corresponding to the unsecured position (72) of the cylinder core (33).

3. Lock according to claim 1, wherein a third microswitch (50") is provided, which is actuated directly or indirectly by the control element (40) as it moves in the axial direction.

4. Lock according to claim 3, wherein the third microswitch (50") is connected to the electrical circuit (90) of first and second microswitches (50, 50') and interrupts this circuit (90) when the control element (40) moves out from the connection plane (69) into the disconnection plane (67), but closes the circuit again during the return movement.

5. Lock according to claim 1, wherein, when the cylinder core (33) is rotated (75, 75') by the key, a central locking device (91) is also actuated, which acts on additional locks and locking mechanisms in the same vehicle, namely, upon rotation (76) of the cylinder core (33) out of the neutral position (70) into the secured position (71) or into the safe-secured position (74), the additional locks are also reset in such a way as to secure them;

but upon rotation (75') into the unsecured position (72), the other locks are moved in such a way as to release them.

6. Lock according to claim 1, wherein, as a result of a rotation of the cylinder core (33) beyond the secured position (71) into the safe-secured position (74), the control element (40) is moved by additional control surfaces (81, 82) out of the disconnection plane (67) into at least one additional, third plane, namely, an overload safety plane (66)

where possibly additional functions can be rendered operative or inoperative by mechanical or electrical elements.

7. Lock according to claim 1, wherein, when the control element (40) is displaced in the axial direction, only part of it leaves the connection plane (69) or disconnection plane (67) and enters the additional plane (66) or planes.

8. Lock according to claim 6, wherein the control surfaces (81, 82) for the axial displacement of the control element (40) or of a part thereof comprises a lift-out profile of an overload safety, which is located between additional elements (38, 39) of the lock.

9. Lock according to claim 8, wherein one of the elements of the overload safety comprises of a channel sleeve (38) surrounding the cylinder core (33), which sleeve has at least one locking channel (37) to allow the entry of the ends of the tumblers (36) provided in the cylinder core (33);

where the channel sleeve (38) is installed in the housing (31, 32) of the lock cylinder in such a way that it cannot move in the axial direction but is free to rotate (86)

and in that a slide ring (39), which also surrounds the cylinder core (33) and which is pressed by an axial elastic force (43) against the channel sleeve (38), is supported with freedom of axial movement but without freedom to rotate in the housing (31, 32), adjacent to the channel sleeve (38);

where, between the channel sleeve (38) and the slide ring (39), a lift-out profile (81, 82) is located, the profile height of which in the axial direction is greater than the distance (68) between the connection and disconnection planes (69, 67);

and in that the two elements (38, 39) are connected to each other nonrotatably up to a certain load limit, but that they separate themselves from each other, against the force of the spring, under overload conditions.

10. Lock according to claim 9, wherein in that the elastic load acting on the slide ring (39) is produced by the pulse spring (46), which is also designed as a compression spring, which serves to move the cylinder core (33) back into its neutral position (70).

11. Lock according to claim 4, wherein the control surfaces for the axial displacement of the control element (40) between the connection plane (69) and the disconnection plane (67) comprises slanted profiles (24, 25) of the two connection parts (35, 45) located between the cylinder core (33) and the control element (40).

12. Lock according to claim 11, wherein, for the axial displacement, the connection parts (45, 35) located between the control element (40) and the cylinder core (33) have control surfaces (24, 25) which slant toward the safe-secured position (74), and in that the control element (40) has a shoulder (58), which, upon key-actuated rotation (57) of the control element (40), contacts a stationary stop (23) in the transition region between the secured position (71) and the safe-secured position (74) of the cylinder core

(33) and stops the further rotation (40"') of the control element.

13. Lock according to claim 1, wherein first and second microswitches (50, 50') are joined to form a combination switch (53) with a common actuating element (54), and in that, depending on the direction in which the control element (40) is rotated (75, 75') by the key, the actuating element (54) actuates either the contact element belonging to the first microswitch (50) or the contact element belonging to the second microswitch (50') of the combination switch (53).

14. Lock according to claim 1, wherein an actuating element (55") of a third microswitch (50") holds the contact elements there in a continuous "on" position while the control element (40) is in its connection plane (69) but keeps them in the "off" position when the control element (40) is in its disconnection plane (67) or its overload safety plane (66).

15. Lock according to claim 13, wherein radial or axial zones (63, 44) or control profiles (61, 62) of the control element (40) which actuate first and second microswitches (50, 50') or the combination switch (53) are different from the zones or profiles which actuate a third microswitch (50").

16. Lock according to claim 1, wherein a working element (18), which acts on the associated locking mechanism upon actuation (76') of the key, is supported (22) on the housing (20);

in that the control element carries a stop (99), which arrives in the path of the working element (18) when the control element (40) is in its disconnection plane (67) or its overload safety plane (66), as a result of which manipulations of the working element (18) are prevented from actuating the locking mechanism;

and in that the stop (99) is moved out of the path of the working element (18), thus allowing actuation of the locking mechanism, when the control element (40) is in its connection plane (69).

17. Lock according to claim 1, wherein the handle (10) is provided with an electrical switch (94), which, upon actuation (16) of the handle (10) while the cylinder core (33) is in the unsecured position (72), renders operative an electrical drive (95) for the associated locking mechanism.

18. Lock according to claim 17, wherein the handle (10) comprises a spring-loaded grip flap (13), the grip flap (13) being designed to keep the contact parts of the associated electrical switch (94) open while in its starting position (13), maintained by spring loading, but to keep the contacts closed when in its actuation position (13').

19. Lock according to claim 18, wherein an elastic latching element (102), which cooperates with a rigid counter-latching element (103) to hold the grip flap (13) in its starting position (13) in a elastically latching manner, also produces a restoring force (111) on the grip flap (13), which force moves the grip flap out of its actuation position (13') and back to its starting position (13) after releasing the hold on the actuated grip flap (13').

20. Lock according to claim 19, wherein the counter-latching element (103) comprises a slanted surface (112), against which the elastic latching element (102) presses, and the slanted surface (112) slants in the direction of the desired starting position (13) of the grip flap, whereas the latching element (102), upon actuation (16) of the grip flap, moves along on the slanted surface (112) under elastic deformation (105') of its elastic part (105).

21. Lock according to claim 19, wherein the elastic latching element (102) comprises a spring-loaded (105) ball (104), which is integrated into the grip flap (13) or into the housing (11) of the grip flap (13).

* * * * *

UNITED STATES PATENT AND TRADEMARK OFFICE

CERTIFICATE OF CORRECTION

PATENT NO. : 6,098,432

DATED : August 8, 2000

INVENTOR(S) : Wolfgang Uwe Spies

It is certified that error appears in the above-identified patent and that said Letters Patent is hereby corrected as shown below:

Title Page:

Item [73] Assignee, Huf Hülsbeck & Fürst GmbH & Co. KG, Velbert, Germany

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*